US006848469B2

(12) United States Patent
Vegliante

(10) Patent No.: US 6,848,469 B2
(45) Date of Patent: Feb. 1, 2005

(54) ADJUSTABLE VALVE FOR A TOILET

(76) Inventor: Paul Vegliante, 363 Indian Trail Dr., Franklin Lakes, NJ (US) 07417

( * ) Notice: Subject to any disclaimer, the term of this patent is extended or adjusted under 35 U.S.C. 154(b) by 0 days.

(21) Appl. No.: 10/461,024

(22) Filed: Jun. 13, 2003

(65) Prior Publication Data

US 2004/0118456 A1 Jun. 24, 2004

Related U.S. Application Data

(60) Provisional application No. 60/388,703, filed on Jun. 14, 2002.

(51) Int. Cl.[7] ..... F16K 31/22; F16K 31/24; F16K 33/00

(52) U.S. Cl. ..... 137/426; 4/324; 4/415; 137/390; 137/430; 137/432; 137/437; 137/444

(58) Field of Search ..... 137/390, 410, 137/426, 430, 432, 434, 437, 442, 443, 444; 4/324, 326, 327, 366, 415

(56) References Cited

U.S. PATENT DOCUMENTS 3,758,893 A * 9/1973 Smolinski et al. ..... 4/327
4,080,986 A * 3/1978 Schoepe ..... 137/426
4,100,928 A * 7/1978 Schoepe ..... 137/437
4,182,364 A * 1/1980 Gilbert et al. ..... 137/426
4,600,031 A * 7/1986 Nestich ..... 137/426
4,615,056 A * 10/1986 Grant ..... 4/366
4,651,359 A * 3/1987 Battle ..... 4/324
4,748,699 A * 6/1988 Stevens ..... 4/324
4,843,657 A * 7/1989 Orr ..... 4/415
4,965,891 A * 10/1990 Antunez ..... 4/415
5,211,204 A * 5/1993 Mikol ..... 137/410
5,287,882 A * 2/1994 Mikol ..... 137/410
5,542,448 A * 8/1996 Campbell et al. ..... 137/410
5,647,067 A 7/1997 Boyle ..... 4/325
5,904,176 A * 5/1999 Li ..... 137/426
6,112,763 A * 9/2000 Orbell ..... 4/327
6,450,195 B1 * 9/2002 Gil ..... 137/426
6,510,866 B2 * 1/2003 Li ..... 137/426

* cited by examiner

*Primary Examiner*—George L. Walton
(74) *Attorney, Agent, or Firm*—Mathews, Collins, Stepherd & McKay, P.A.

(57) ABSTRACT

The present invention relates to an adjustable valve for a toilet in which the valve remains in a lower setting unless it is activated by the user to a higher setting and automatically returns to the lower setting after flushing the toilet. The amount of water used for each flush is dependent on the water level in the toilet tank. The water level in the tank is set by adjusting the height of the valve assembly. The valve assembly can be activated by the user to raise the height of the valve assembly and maintain the height using a release clip, thereby increasing the amount of water in the tank. When the handle is pressed to flush the toilet, the release clip is pulled back by a chain extending from the handle and the adjustable valve springs back to the lower setting.

11 Claims, 10 Drawing Sheets

ADJUSTABLE VALVE FOR A TOILET

CROSS REFERENCE TO RELATED APPLICATION

This application claims priority of U.S. Provisional Patent Application Ser. No. 60/388,703 filed Jun. 4, 2002, entitled "Adjustable Valve for a Toilet" the contents of which are incorporated in their entirety by reference into this application.

BACKGROUND OF THE INVENTION

1. Field of the Invention

The present invention relates to an adjustable valve for a toilet for selectively adjusting the amount of water in the tank.

2. Description of the Related Art

The use of devices for flushing toilets is known. In addition, apparatus for selectively flushing a toilet with either a full or partial tank of water have been described. U.S. Pat. No. 5,647,067 describes an apparatus for flushing a toilet with either a partial or full tank of water in which the apparatus includes control mechanisms which are rotatably secured to the front of the toilet tank for operation and control by a user. The control mechanisms include a first short flush handle adapted for rotation about a horizontal axis and a second normal long flush handle adapted for rotation independent of the rotation of the short flush handle and about the same axis of rotation. A rod in the upper extent of the tank is coupled at its inboard end to the short flush handle with a first mechanism coupled to the aperture of the flush plug for raising the flush plug upon the rotation of the short flush handle. A long rod is secured to the flush handle for rotational movement with respect to the normal flush handle and with an exterior end which has an aperture and a second mechanism. The upper end of the second mechanism is secured to the exterior end of the normal flush handle. The lower end of the second mechanism is coupled to the aperture of the normal long flush handle whereby the user may rotate the short handle for a less than full flush and rotate the normal long flush handle for an entire flush of the water in the toilet tank.

It is desirable to provide an improvement for selectively flushing a toilet with a selective amount of water in an uncomplicated manner in which the valve remains in a lower setting for partial tank flush unless the valve is activated by the user. The intended purpose is to reduce the amount of water used for flushing liquid waste, i.e., urine, when a full flush is not necessary, i.e., little or no toilet paper or other wastes. The improvement depending on the extent of use can save millions to billions of gallons of water per day.

SUMMARY OF THE INVENTION

The present invention relates to an adjustable valve for a toilet in which the valve remains in a lower setting unless it is activated by the user to a higher setting and automatically returns to the lower setting after flushing the toilet. The amount of water used for each flush is dependent on the water level in the toilet tank. The water level in the tank is set by adjusting the height of the valve assembly. The valve assembly can be activated by the user to raise the height of the valve assembly and maintain the height using a release clip, thereby increasing the amount of water in the tank. When the handle is pressed to flush the toilet, the release clip is pulled back by a chain extending from the handle and the adjustable valve springs back to the lower setting.

The present invention has the advantage of reducing the consumption of water by automatically using a lower water setting unless a user activates a higher setting. The invention will be more fully described by reference to the following drawings.

DETAILED DESCRIPTION

Figure 1:
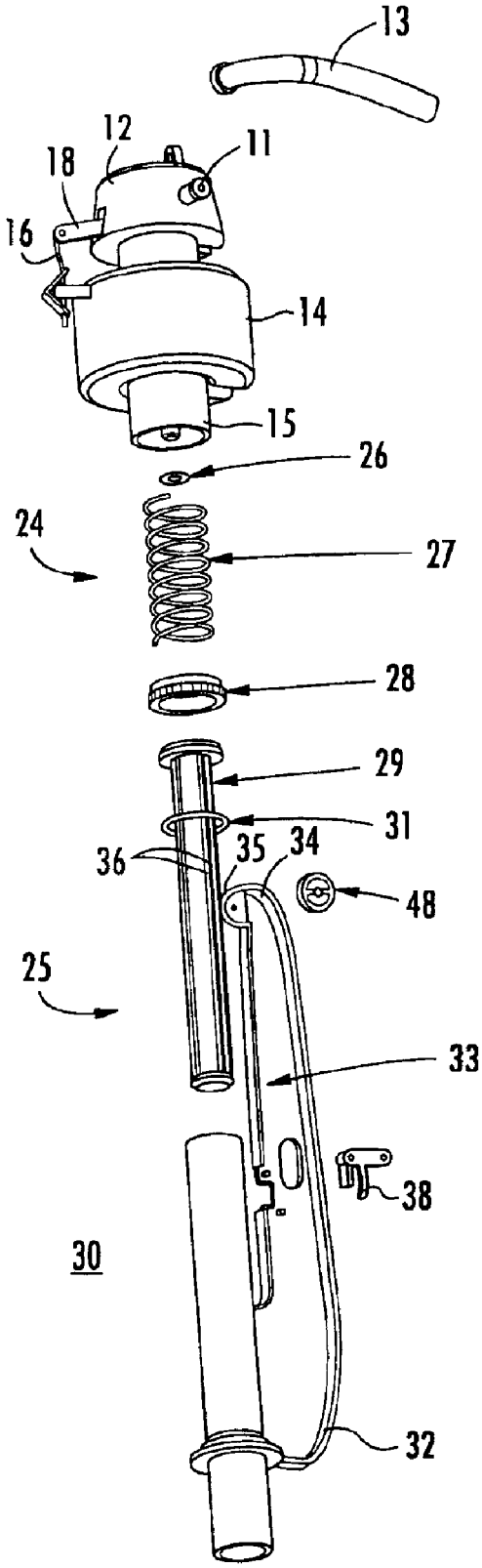
FIG. 1 is a perspective view of assembly of an adjustable valve apparatus in accordance with the teachings of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

Figure 2:
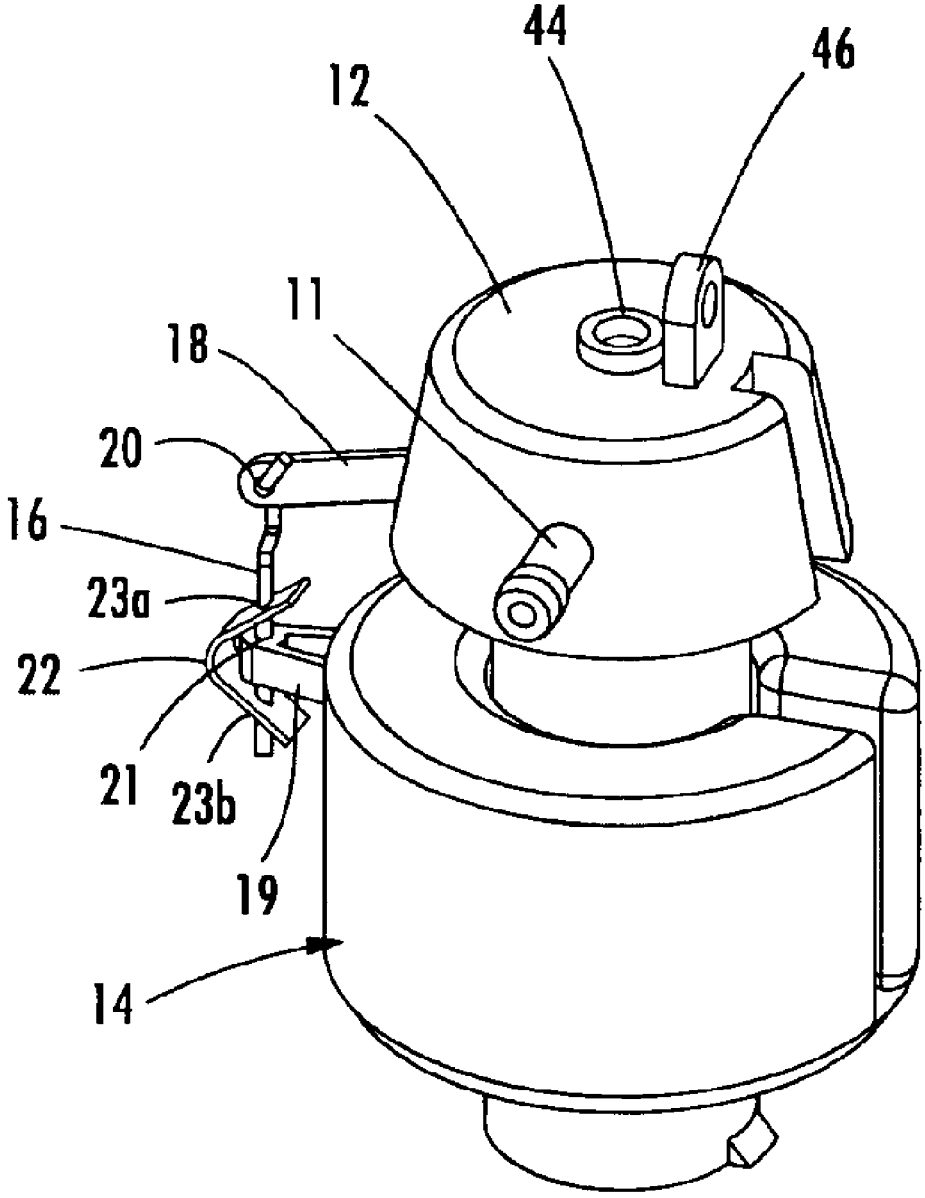
FIG. 2 is a perspective view of a valve head and float of the present invention.

FIG. 1 is a perspective view of adjustable valve apparatus 10 in accordance with the teachings of the present invention. Water outlet tube 11 extends from valve head 12. Hose 13 can be coupled to water outlet tube 11. Valve head 12 is adjustably coupled to float 14 using actuation lever rod 16, as shown in FIG. 2. Valve actuation lever 18 extends from valve head 12. Protrusion 19 extends from float 14. Actuation lever rod 16 is received in aperture 20 of valve actuation lever 18 and aperture 21 of protrusion 19. Actuation lever rod 16 is received in apertures 23*a* and 23*b* of float adjustment clip 22. Float adjustment clip 22 is received over protrusion 19.

Float 14 is coupled with coupling means 24 to lower housing 25, as shown in FIG. 1. For example, coupling means 24 can include O-ring 26, bias member 27 and valve nut 28 for coupling lower portion 15 of float 14 to inner tube 29. Inner tube 29 is slidably received in outer tube 30 of lower housing 25. O-ring 31 seals inner tube 29 to outer tube 30.

Lower portion 32 of lower housing arm 33 is attached to outer tube 30. Upper portion 34 of lower housing arm 33 includes protrusions 35 for sliding in corresponding ridges 36 of inner tube 29 during raising or lowering of valve head 12 along lower housing arm 33, as described in detail below. Release clip 38 attaches to lower housing arm 33.

Figure 3:
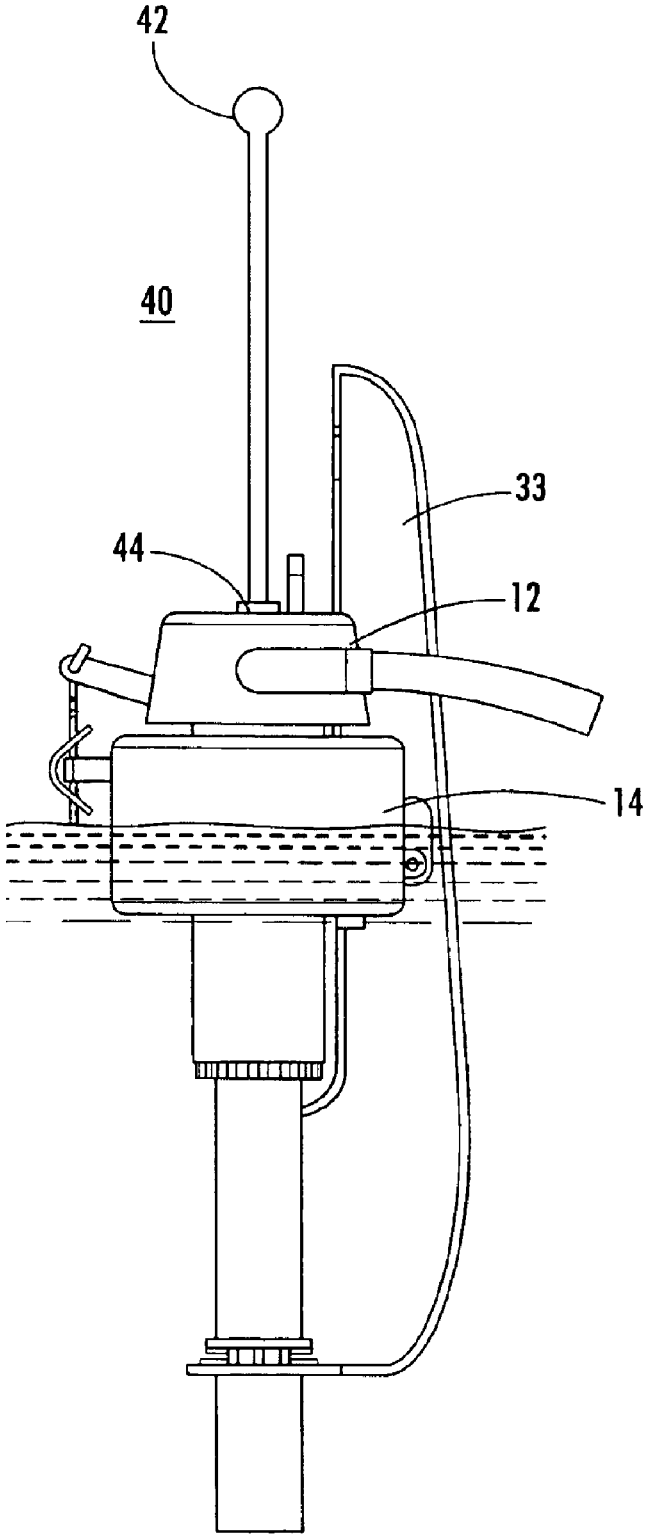
FIG. 3 is a side elevational view of an activation mechanism for the adjustable valve apparatus of the present invention.
Figure 4:
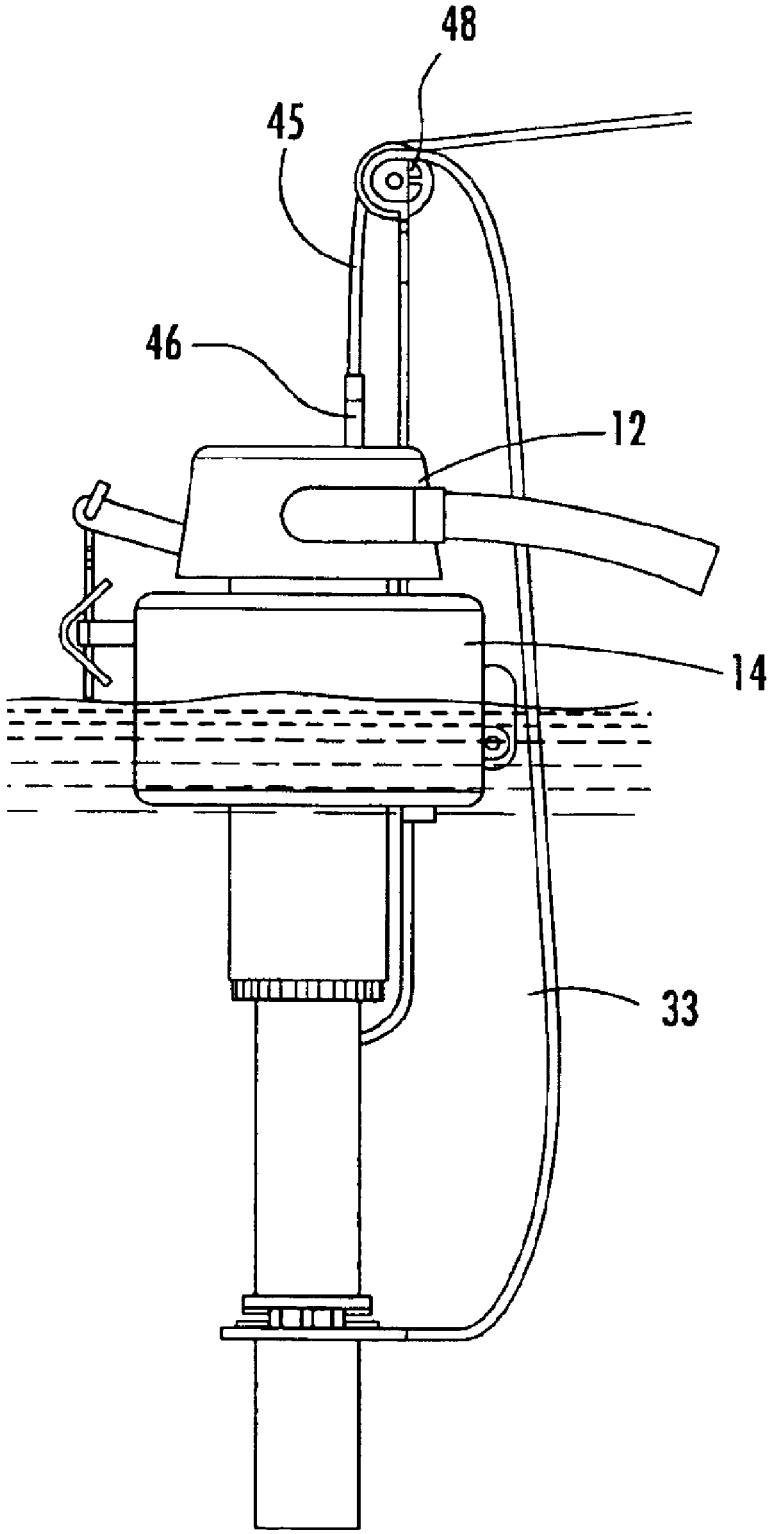
FIG. 4 is a side elevational view of an alternate activation mechanism for the adjustable valve apparatus of the present invention.
Figure 5:
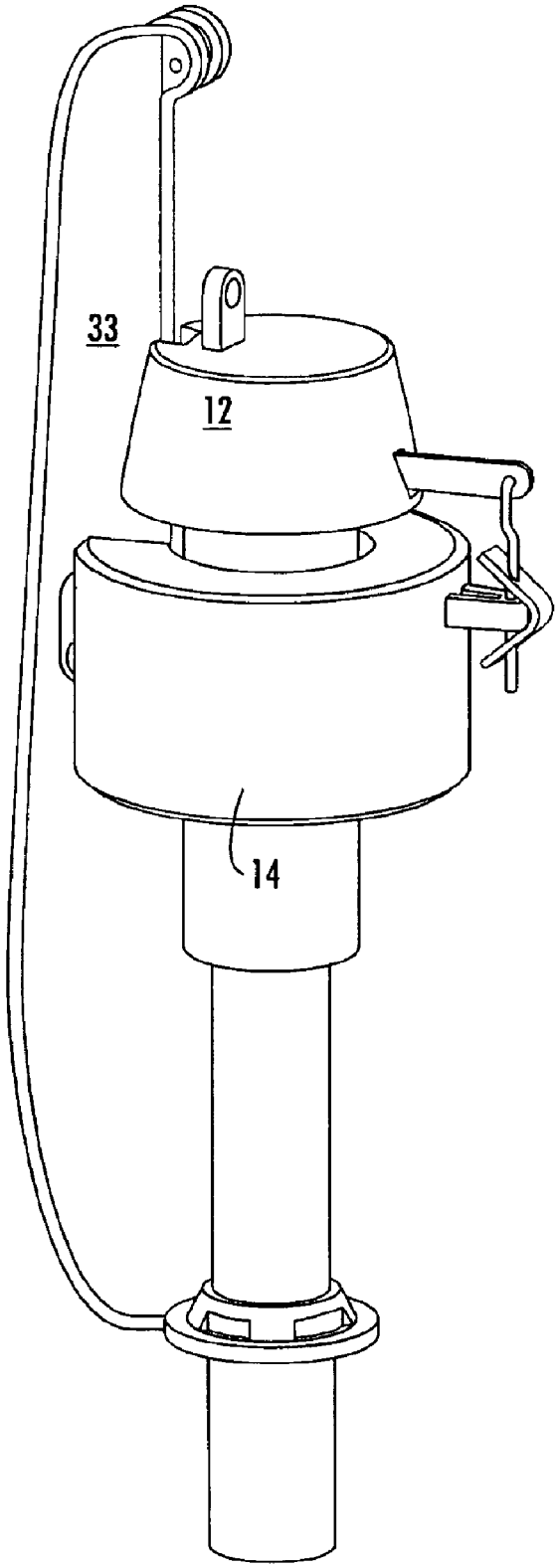
FIG. 5 is a perspective view of the adjustable valve apparatus in a normal setting.
Figure 6:
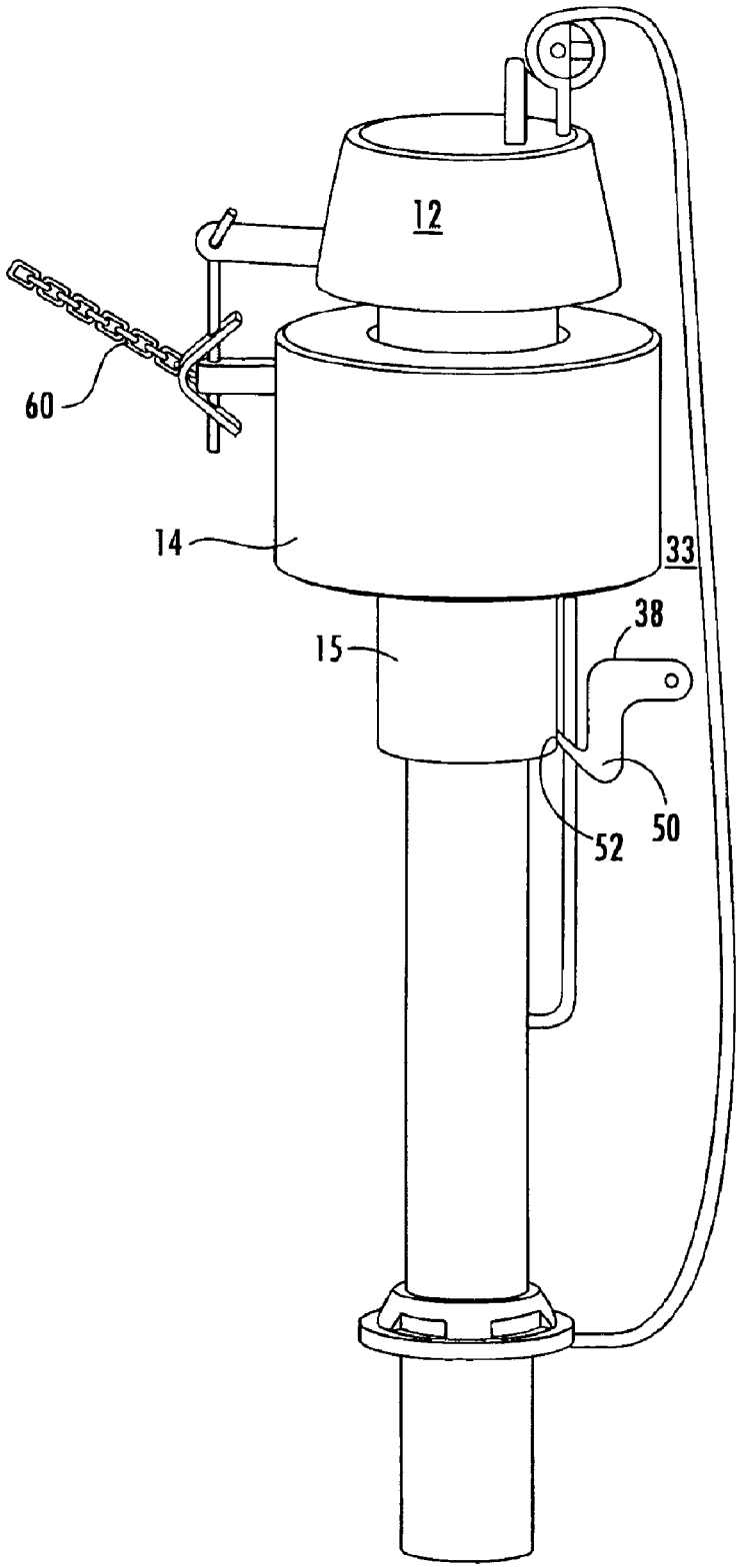
FIG. 6 is a perspective view of the adjustable valve apparatus in a high setting.

Activation mechanism 40 can be used for activating adjustable valve apparatus into a higher setting of a large tank flush. In one embodiment, activation mechanism 40 comprises pull rod 42 which can be attached to thread mount 44 of valve head 12, as shown in FIG. 3. Alternatively, activation mechanism 40 comprises cable 45 which can be thread through eyelet 46 of valve head 12 and around pulley 48, as shown in FIG. 4. Pull rod 42 and pulley 48 are used for raising valve head 12 along lower housing arm 33 from a normal lower setting of a partial tank flush, as shown in FIG. 5 to a higher setting of a large tank flush, as shown in FIG. 6. Pull rod 42 and pulley 48 can be attached to an activation device, such as a button (not shown) on the outside of the toilet and a motorized device for raising pull rod 42 or cable 35 thereby raising valve head 12 along lower housing arm 33. As shown in FIG. 6, after valve head 12 is raised to the higher setting of a large flush, end 50 of release clip 38 contacts notch 52 of lower portion 15 of float 14 to retain float 14 in the higher setting.

Figure 7A:
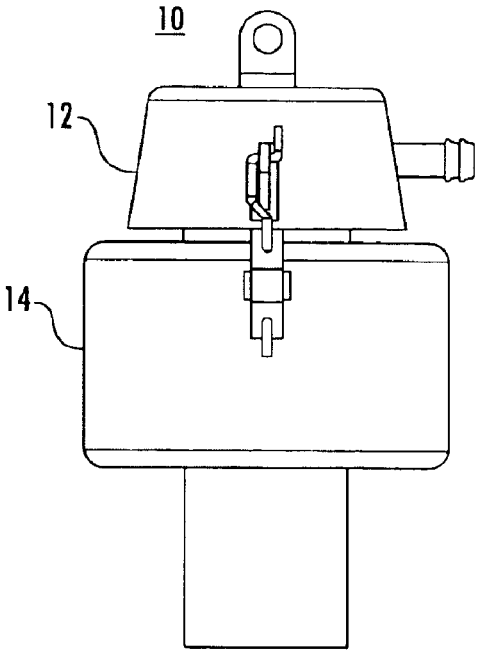
FIG. 7A is a side elevation of the adjustable valve apparatus in a closed position.
Figure 7B:
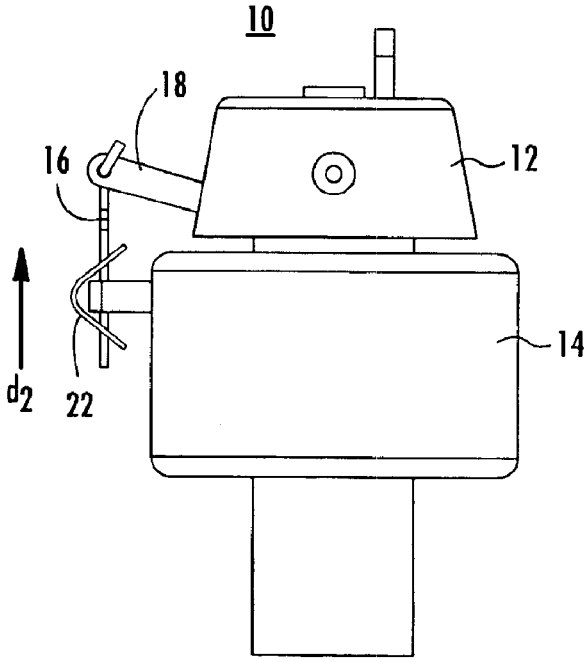
FIG. 7B is a front elevational view of the adjustable valve apparatus in a closed position.
Figure 7C:
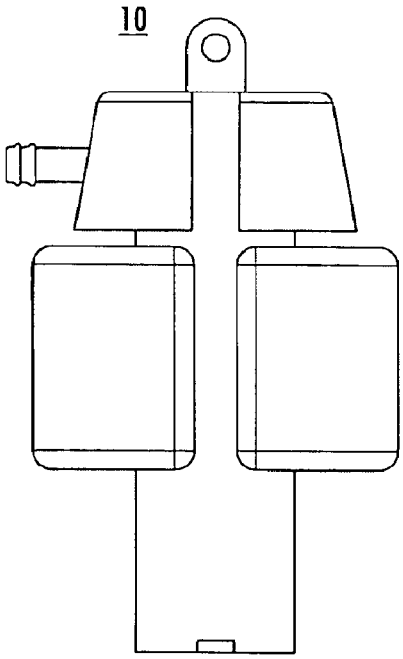
FIG. 7C is a side elevational view of the opposite side of FIG. 7B of the adjustable valve apparatus in a closed position.
Figure 8A:
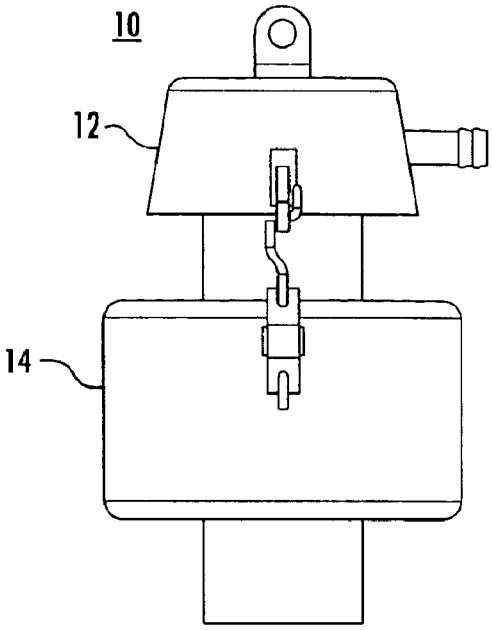
FIG. 8A is a side elevation of the adjustable valve apparatus in an open position.
Figure 8B:
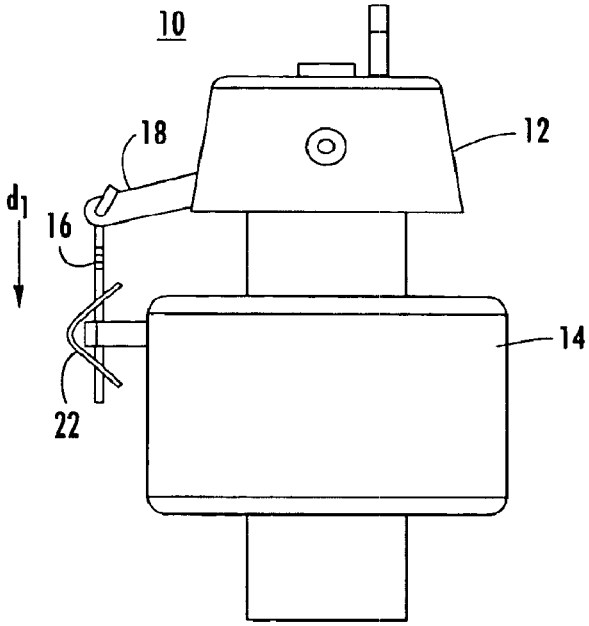
FIG. 8B is a front elevational view of the adjustable valve apparatus in an open position.
Figure 8C:
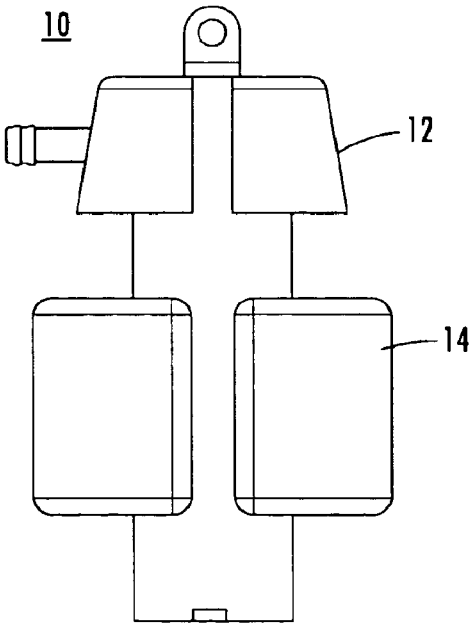
FIG. 8C is a side elevational view of the opposite side of FIG. 8B of the adjustable valve apparatus in an open position.
Figure 9:
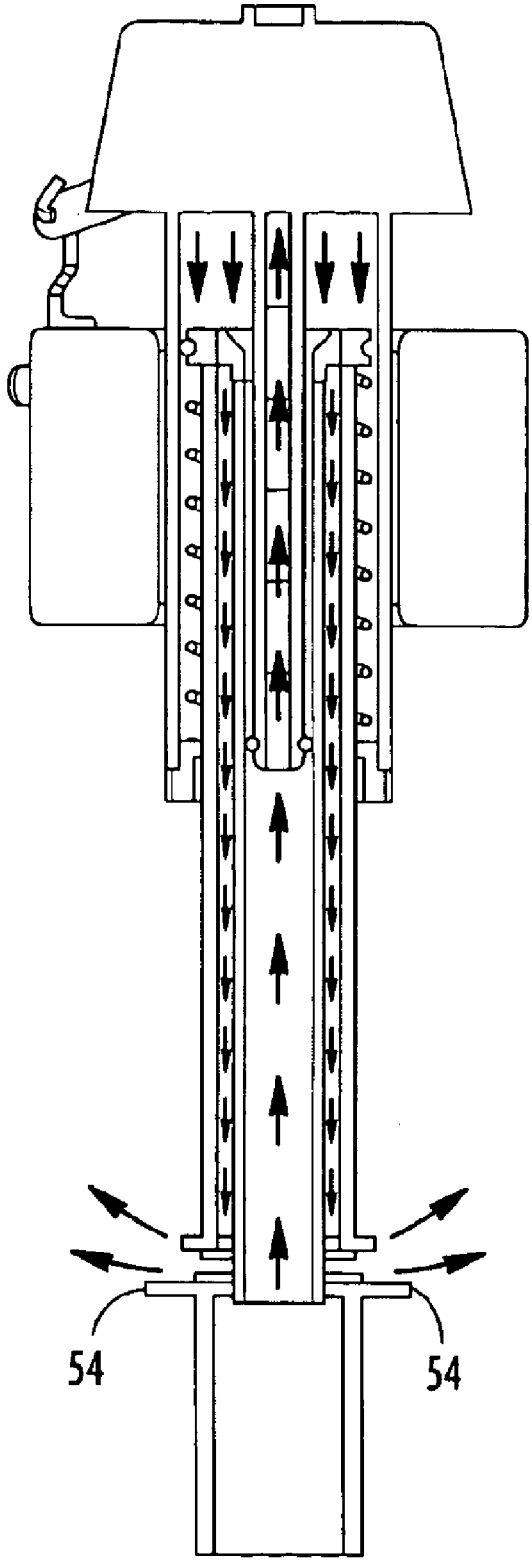
FIG. 9 is a cross sectional view of the adjustable valve apparatus and water flow direction.

FIGS. 7*a*–7*c* and 8*a*–8*c* illustrate operation of adjustable valve apparatus 10 in a respective closed and open position. Adjustable valve apparatus 10 controls flow of water into the tank and into the toilet bowl (not shown) upon flushing the toilet. Before flushing the toilet, adjustable valve apparatus 10 is closed as shown in FIGS. 7*a*–7*c*. In the closed position, float 14 is adjacent valve head 12. Valve actuation lever 18 extends upwardly from valve head 12. When the toilet is flushed, water in the tank flows into the bowl. As float 14 drops down, valve actuation lever 18 and actuation lever rod 16 drops down in the direction of $d_1$ and brings float adjustment clip 22 down, as shown in FIGS. 8*a*–8*c*. When valve actuation lever 18 drops down, float 14 moves away from valve head 12 and adjustable valve apparatus 10 is opened to allow water to flow through adjustable valve apparatus 10. Water flows through adjustable valve apparatus 10 in the direction of the arrows, as shown in FIG. 9. Water exits adjustable valve apparatus 10 at water outlet tube 11 (not shown) and bottom water outlet 54. Water flowing through water outlet tube 11 flows into the toilet bowl. Water flowing through bottom water outlet 54 refills the tank. Float 14 rises in the direction of $d_2$ with the water level in the tank and moves up float adjustment clip 22, actuation lever rod 16 and valve actuation lever 18 for closing adjustable valve apparatus 10. In the closed position, adjustable valve apparatus 10 shuts off the water flowing into the tank and bowl.

Figure 10C:
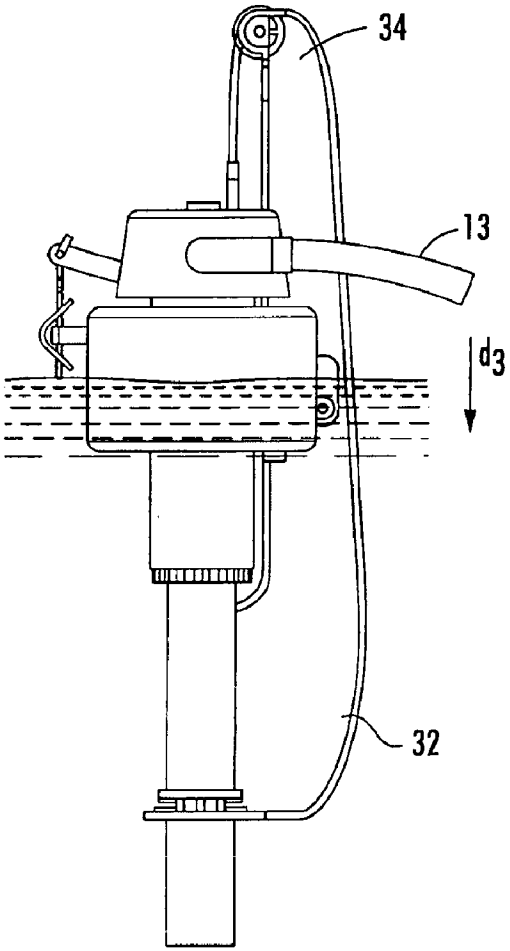
FIG. 10C is a side elevational view of operation of the adjustable valve upon return to a normal setting having a standard water level.
Figure 10B:
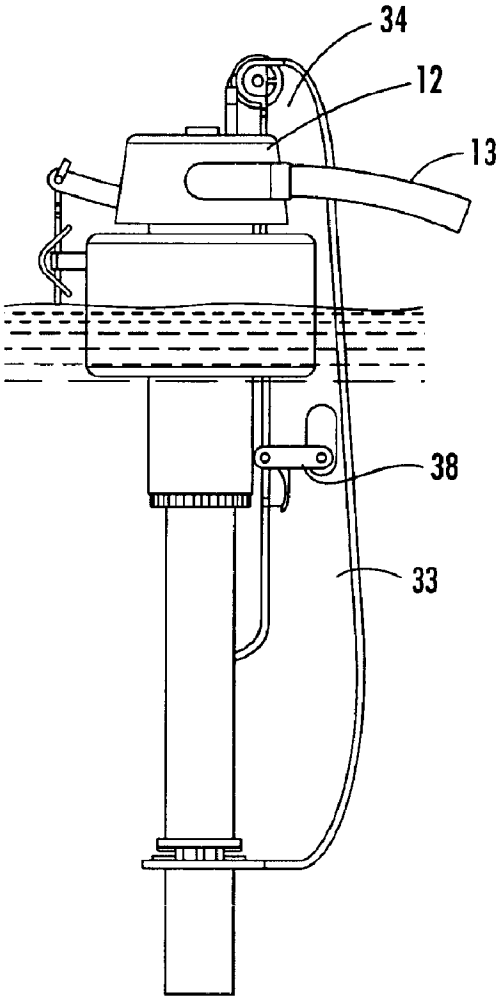
FIG. 10B is a side elevational view of operation of the adjustable valve apparatus in a high setting having a higher water level.
Figure 10A:
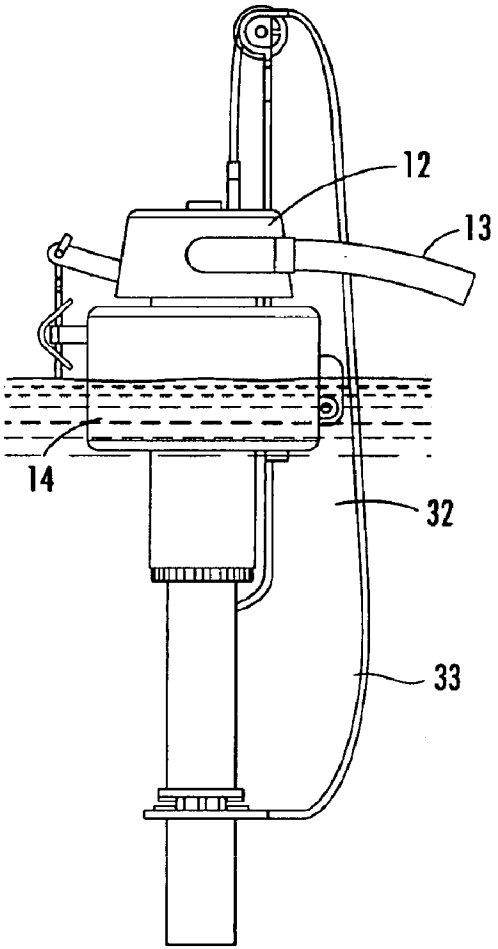
FIG. 10A is a side elevational view of operation of the adjustable valve apparatus in a normal setting having a standard water level.

The amount of water used for each flush is dependent on the water level in the tank. FIG. 10*a* illustrates a normal lower setting in which float 14 is positioned adjacent lower portion 32 of lower housing arm 33. In this position, the water level is a standard water level for a partial tank flush. Adjustable valve apparatus 10 is raised to a higher water level in which valve head 12 is positioned adjacent upper portion 34 of lower housing arm 33 using activation mechanism 40, as described above, to provide a large flush, as shown in FIG. 10*b*. Release clip 35 retains adjustable valve apparatus 10 in the upper water level position. As adjustable valve apparatus 10 is raised to an upper water position, adjustable valve apparatus 10 opens (as shown in FIG. 9) and begins to fill the water level in the tank to an upper level. When the handle is pressed to flush the toilet, release clip 38 is pulled back from lower housing arm 33, such as by chain 60 attached to a handle of the toilet as shown in FIG. 6. Adjustable valve apparatus 10 drops in direction of $d_3$ to spring back and allow adjustable valve apparatus 10 to return to the normal setting, as shown in FIG. 10*c*.

It is to be understood that the above-described embodiments are illustrative of only a few of the many possible specific embodiments which can represent applications of the principles of the invention. Numerous and varied other arrangements can be readily devised in accordance with these principles by those skilled in the art without departing from the spirit and scope of the invention.

What is claimed is:

1. An adjustable valve for a toilet comprising:

a valve head adjustably coupled to a float;

a first housing having a first end coupled to said float;

a second end of said first housing slidably coupled to a second housing;

activation means for activating said adjustable valve for raising said valve head and said float to a higher setting by raising said valve head and said float along said second housing;

retaining means for retaining said valve head and float at said high setting, and releasing means for automatically releasing said retaining means upon flushing of said toilet for returning said valve head and said float to lower setting;

wherein a distance between said valve head and said float can be adjusted for moving said valve into an open position or a closed position.

2. The valve of claim 1 wherein said valve head is adjustably coupled to said float with an activating lever rod received in an aperture of a valve actuation lever extending from said valve head and an aperture of a protrusion extending from said float, said valve actuation lever extends upwardly from said valve head in said closed position such that said valve head is adjacent said float and said valve actuation lever drops down into said open position when said toilet is flushed such that said float moves away from said valve head.

3. The valve of claim 2 further comprising a float adjustment clip received over said protrusion.

4. The valve of claim 1 wherein said second end of said first housing comprises an inner tube, said second housing comprises an outer tube and said inner tube is slidably received in said outer tube.

5. The valve of claim 4 wherein said second housing further comprises a lower housing arm attached to said outer tube.

6. An adjustable valve for a toilet comprising:

a valve head adjustably coupled to a float;

a first housing having a first end coupled to said float;

a second end of said first housing slidably coupled to a second housing, said second end of said first housing comprises an inner tube, said second housing comprises an outer tube, said inner tube is slidably received in said outer tube;

a lower housing arm attached to said outer tube;

activation means for activating said adjustable valve for raising said valve head and said float to a higher setting by raising said valve head and said float along said second housing;

retaining means for retaining said valve head and float at said higher setting; and said retaining means comprises a release clip attached to said lower housing arm, for automatically releasing said release clip upon flushing said toilet for returning said valve head and said float to a lower setting said release clip contacting a notch in said float for retaining said float in said higher setting, wherein a distance between said valve head and said float can be adjusted for moving said valve into an open position or a closed position.

7. The valve of claim 6 wherein said release clip can be released from contact with said notch for allowing said valve head and said float to return to a lower setting.

8. The valve of claim 7 wherein said release clip is automatically released from contact with said notch upon flushing of said toilet for returning said valve head and said float to a lower setting.

9. The valve of claim 8 wherein a chain is attached from said release clip and is adapted to be attached to a handle of the toilet.

10. An adjustable valve for a toilet comprising:

a valve head adjustably coupled to a float;

a first housing having a first end coupled to said float;

a second end of said first housing slidably coupled to a second housing;

activation means for activating said adjustable valve for raising said valve head and said float to a higher setting by raising said valve head and said float along said second housing;

retaining means for retaining said valve head and float at said higher setting, retaining means releases automatically upon flushing said toilet for returning said valve head and said float to a lower setting, and said activation means for activating said adjustable valve comprises a pull rod attached to said valve head and said pull rod is raised for raising said valve head to said higher setting, wherein a distance between said valve head and said float can be adjusted for moving said valve into an open position or a closed position.

11. An adjustable valve for a toilet comprising:

a valve head adjustable coupled to a float;

a first housing having a first end coupled to said float;

a second end of said first housing slidably coupled to a second housing;

activation means for activating said adjustable valve for raising said valve head and said float to a higher setting by raising said valve head and said float along said second housing;

retaining means for retaining said valve head and float at said high setting, retaining means releases automatically upon flushing said toilet for returning said valve head and said float to a lower setting, and said activation means for activating said adjustable valve comprises a pulley attached to said second housing, an eyelet attached to said valve head and a cable extending through said eyelet and around said pulley and said cable is raised for raising said valve head to said higher setting.

* * * * *